US006185826B1

(12) United States Patent
Lutz et al.

(10) Patent No.: US 6,185,826 B1
(45) Date of Patent: Feb. 13, 2001

(54) ELECTRIC SLICING KNIFE WITH SWITCH GUARD

(76) Inventors: Scott Lutz, 118 Linden St. Second Floor, New Haven, CT (US) 06511; Stuart Naft, 48 Cornell Rd., Fairfield, CT (US) 06432; Joseph Paul, P.O. Box 1053, New Milford, CT (US) 06776; Joseph Toro, 86 Willow Ave., Stratford, CT (US) 06615

( * ) Notice: Under 35 U.S.C. 154(b), the term of this patent shall be extended for 0 days.

(21) Appl. No.: 09/311,809

(22) Filed: May 13, 1999

(51) Int. Cl.[7] ..... B26B 7/00
(52) U.S. Cl. ..... 30/277.4; 30/272.1
(58) Field of Search ..... 30/277.4, 272.1, 30/228, 392–394, 369; 200/553

(56) References Cited

U.S. PATENT DOCUMENTS

| | | | | |
|---|---|---|---|---|
| 3,132,227 | | 5/1964 | Butler . | |
| 3,194,084 | | 7/1965 | Filander . | |
| 3,234,649 | * | 2/1966 | Preble et al. | 30/277.4 |
| 3,300,858 | * | 1/1967 | Young | 30/277.4 |
| 3,308,535 | | 3/1967 | Freeman et al. . | |
| 3,315,356 | | 4/1967 | Swanke et al. . | |
| 3,322,925 | | 5/1967 | Korshak . | |
| 3,337,954 | | 8/1967 | Robison . | |
| 3,339,282 | | 9/1967 | Hansen . | |
| 3,358,108 | | 12/1967 | Hansen . | |
| 3,379,852 | | 4/1968 | Korshak . | |
| 3,417,469 | | 12/1968 | Cousins et al. . | |
| 3,461,556 | | 8/1969 | Chambers . | |
| 3,650,029 | | 3/1972 | Trelc . | |
| 3,766,352 | | 10/1973 | Bigley et al. . | |
| 3,823,291 | | 7/1974 | Milcoy . | |
| 3,873,796 | | 3/1975 | Worobec, Jr. . | |
| 4,006,334 | | 2/1977 | Robotham et al. . | |
| 4,122,320 | | 10/1978 | Edgell et al. . | |
| 5,778,541 | | 7/1998 | McClung . | |

* cited by examiner

*Primary Examiner*—Douglas D. Watts
(74) *Attorney, Agent, or Firm*—Barry E. Deutsch

(57) ABSTRACT

An electrically operated slicing knife includes an axially movable switch guard overlying the switch of the knife. The switch guard is movable to a first position whereat the switch is uncovered and a second position whereat the switch is covered to prevent a user from actuating the switch. A pair of user actuated buttons control ejection of the blade of the knife. When the buttons are in a first position, the blade is locked relative to the knife handle, and the switch guard when positioned to uncover the knife switch maintains the buttons in their locked position. When the switch guard is moved to cover the switch, the buttons can be actuated by a user to unlock the blades from the knife handle.

15 Claims, 5 Drawing Sheets

ELECTRIC SLICING KNIFE WITH SWITCH GUARD

BACKGROUND OF THE INVENTION

The present invention relates to an electrically powered slicing knife, and in particular to an electric knife having a switch guard functioning to reduce the possibility of injury to a user of the knife when the user desires to remove the blades thereof.

Electrically operated slicing knives are among the most popular small kitchen electrical appliances. Most of these slicing knives comprise a pair of blades releaseably secured together and reciprocated by a suitable electric motor contained in a housing. The blades are in sliding contact with each other.

During normal usage of the slicing knife, for example, when cutting meat, the blades become dirty and require cleaning. During the cutting operation, the blades are securely held within the knife housing and are connected to the motor. To enable the blades to be readily cleaned, it is desirable that the blades be easily removable from the housing. To minimize the potential of injury to the user, it is important that the knife include means to reduce the possibility that the knife will be accidentally energized when the blades are being either removed from or reinserted into the housing.

Accordingly, it is an object of the invention to provide in an electric slicing knife means to minimize the possibility of injury to a user when the user is removing blades from the knife housing.

SUMMARY OF THE INVENTION

The foregoing object and other objects of the invention are obtained in an electrically operating slicing knife including a housing having an electric motor mounted in the housing. Gear means are provided for converting rotary motion of the motor to reciprocating motion of the blades. A pair of blade holders are connected to the gear means for opposite reciprocating motion with respect to each other. The knife further includes a pair of blade members having adjacent faces in sliding engagement with each other and having a cutting portion and a tang portion. The tang portion of a first blade member is received by a first blade holder, and a tang portion of the second blade member is received by the second blade holder. A resilient member releaseably secures the blade members in the blade holders. A user operated switch selectively connects the motor to a source of electrical power. A guard overlies the switch and is movable between a first position whereat the switch is uncovered to permit activation by the user and a second position whereat the switch is covered to prevent activation by the user. A movable locking means is in operative relationship with the resilient member and the guard. The switch guard moves and retains the locking means in a locking position relative to the resilient member when in the first position. The guard when in the second position enables the user to move the locking means into an unlocking position relative to the resilient member.

The object of this invention is also obtained in a method of operating an electrically powered knife comprising the steps of inserting a knife blade into a knife handle for cutting purposes; placing an actuating switch in an on position to operate the blades in a cutting motion while simultaneously preventing the user from removing the blades from the handle; placing the switch in an off position to deactivate the blades; and blocking the switch to prevent user actuation while simultaneously enabling the user to remove the blades from the handle.

DESCRIPTION OF THE PREFERRED EMBODIMENT

Figure 1:
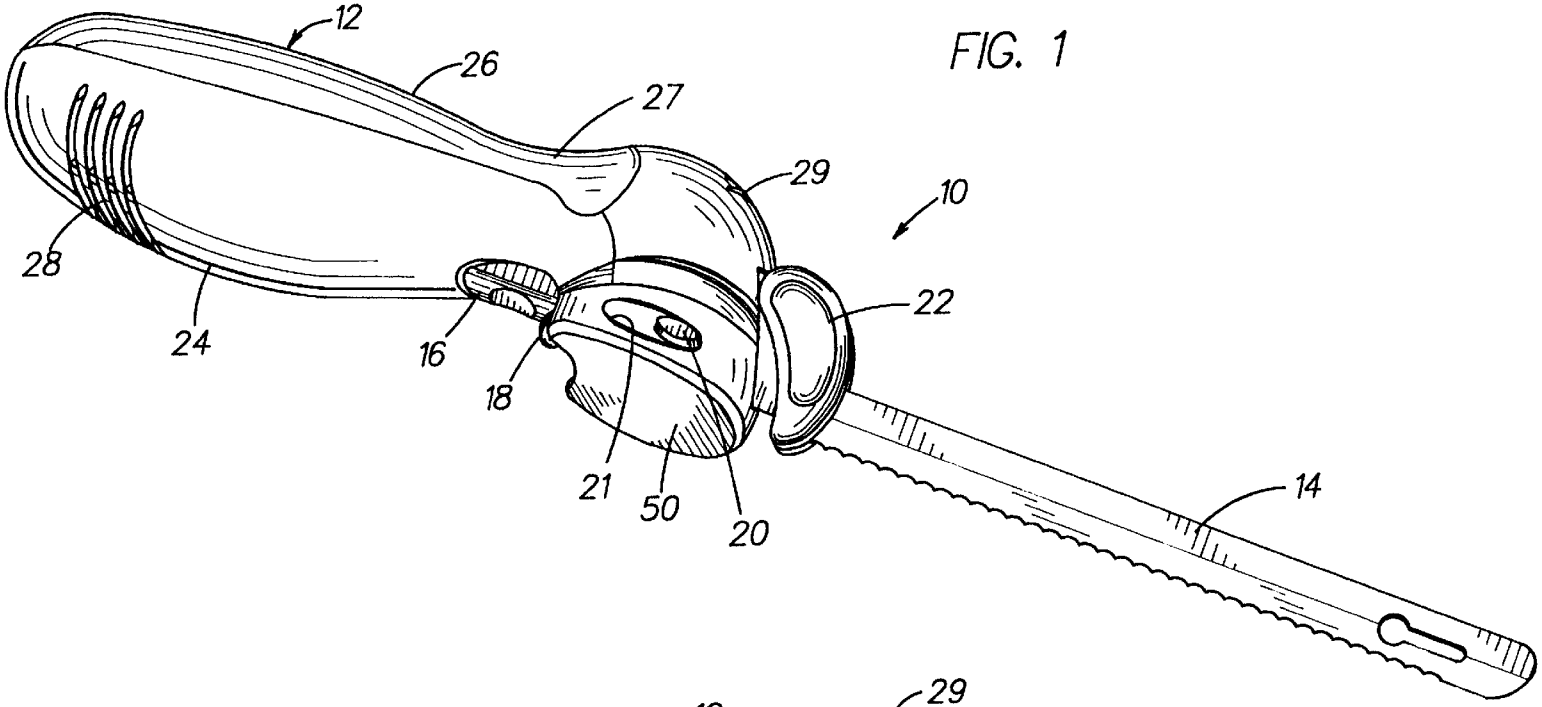
FIG. 1 is a perspective view of an electric slicing knife including the present invention in an operating state.

Referring now to the various figures of the drawing, there is disclosed a preferred embodiment of the present invention. In referring to the various figures of the drawing, like numerals shall refer to like parts.

Figure 2:
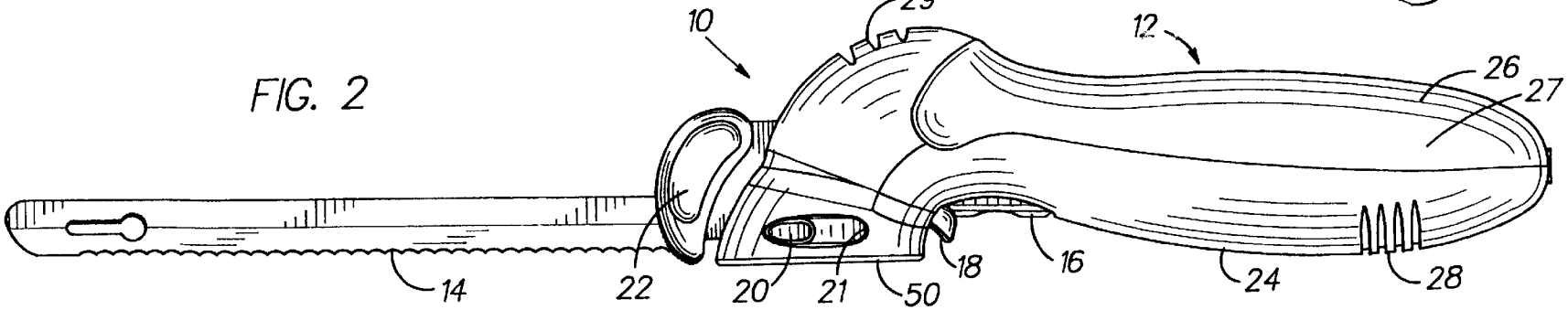
FIG. 2 is a view similar to that shown in FIG. 1 but taken from a side opposite to that shown in FIG. 1.

Referring specifically to FIGS. 1 and 2, there is disclosed an electrically operated slicing knife 10 having a housing generally designated by the reference numeral 12. A pair of blade members 14 are mounted in housing 12. Blade numbers 14 have adjacent faces in sliding engagement with each other. Each of the blades includes an ear-like member 22 for enabling a user to manipulate a blade. Each of the ears 22 is made from a thermoplastic rubber overmolded over an ABS plastic substrate or other suitable plastic material. In the preferred embodiment, the thermoplastic rubber has been obtained from Teknor Apex Company, Pawtucket, R.I., and is sold under the trademark "Tekbond".

Housing 12 includes lower and upper housing portions respectively 24, 26. Lower housing portion 24 includes air vents 28. Upper housing portion 26 includes air vents 29. Housing 12 is made from polycarbonate plastic. Upper housing portion 26 includes an overmolded section 27. Section 27 is overmolded with "Tekbond" thermoplastic rubber. Housing 12 further includes a lower housing portion 50 at the end of the housing proximate ears 22. Housing portion 50 is also overmolded with the "Tekbond" thermoplastic rubber.

Figure 8:
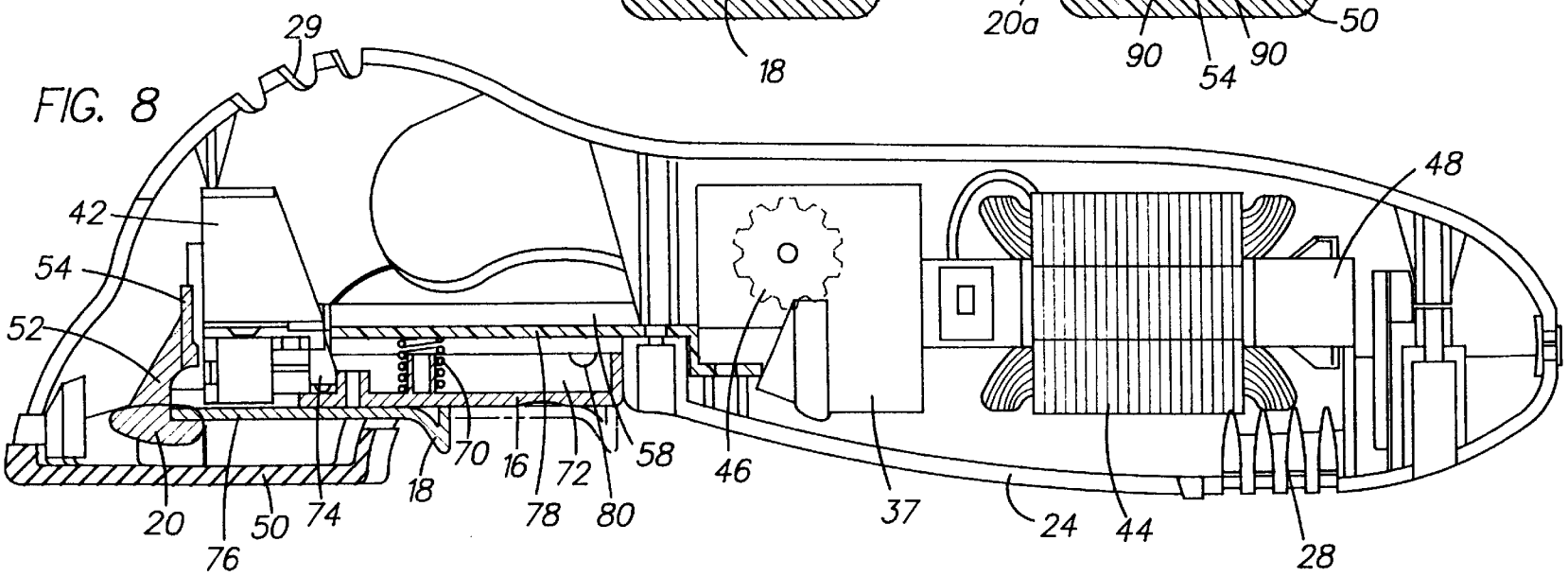
FIG. 8 is a longitudinal sectional view of the electric slicing knife in accordance with the present invention.

Housing portion 50 has a pair of openings 21 extending therethrough for accommodating user operated button assemblies 20. Each assembly 20 includes a button actuator 20A, 20B. A user operated switch 16 is mounted in lower housing portion 24. In the preferred embodiment, switch 16 is a rocker-type switch, which, when actuated by the user to an on position, connects motor 44 (shown in FIG. 8) to a source of electrical power. Switch 16 rotates about integral pivots 80. Switch 16 mounts spring 70 which maintains switch 16 in an open state. Switch 16 includes axially extending tracks 72. Switch 16 when placed in an on state actuates switch 74. A guard 18 is moveable relative to switch 16 for a reason to be more fully explained hereinafter. As shown in FIG. 8, when guard 18 is moved forwardly relative to switch 16 (the solid line position for guard 18), switch 16 is exposed for use by the user. When guard 18 is moved rearwardly relative to switch 16 (as shown in dotted or phantom lines), guard 18 overlies switch 16 to prevent the user from actuating the same. Tracks 72 guide the movement of guard 18 relative to switch 16. Guard 18 includes finger tab 76 for enabling the user to easily move the guard.

Figure 3:
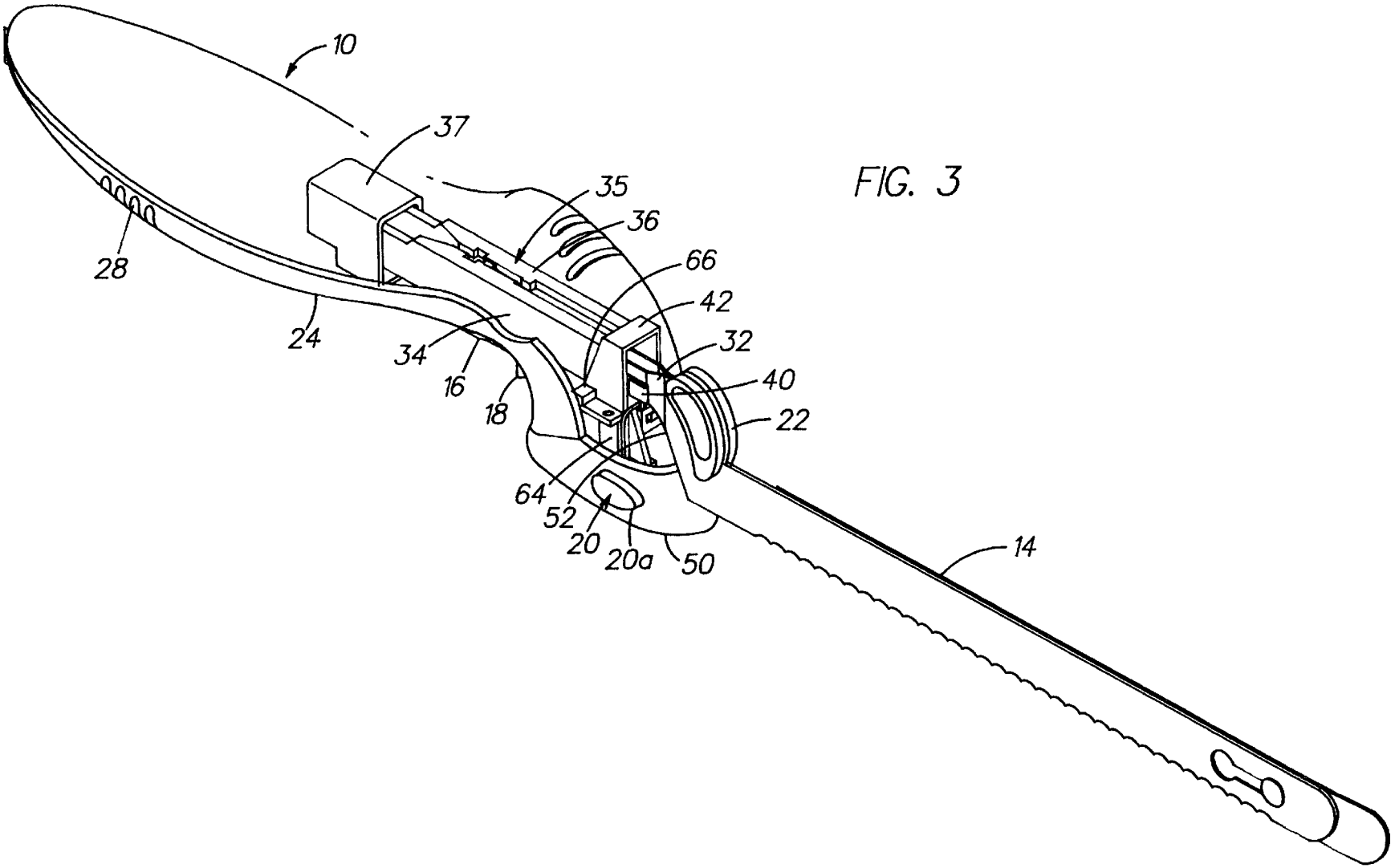
FIG. 3 is a perspective view with parts broken away and some omitted for purposes of clarity further illustrating the present invention.
Figure 4:
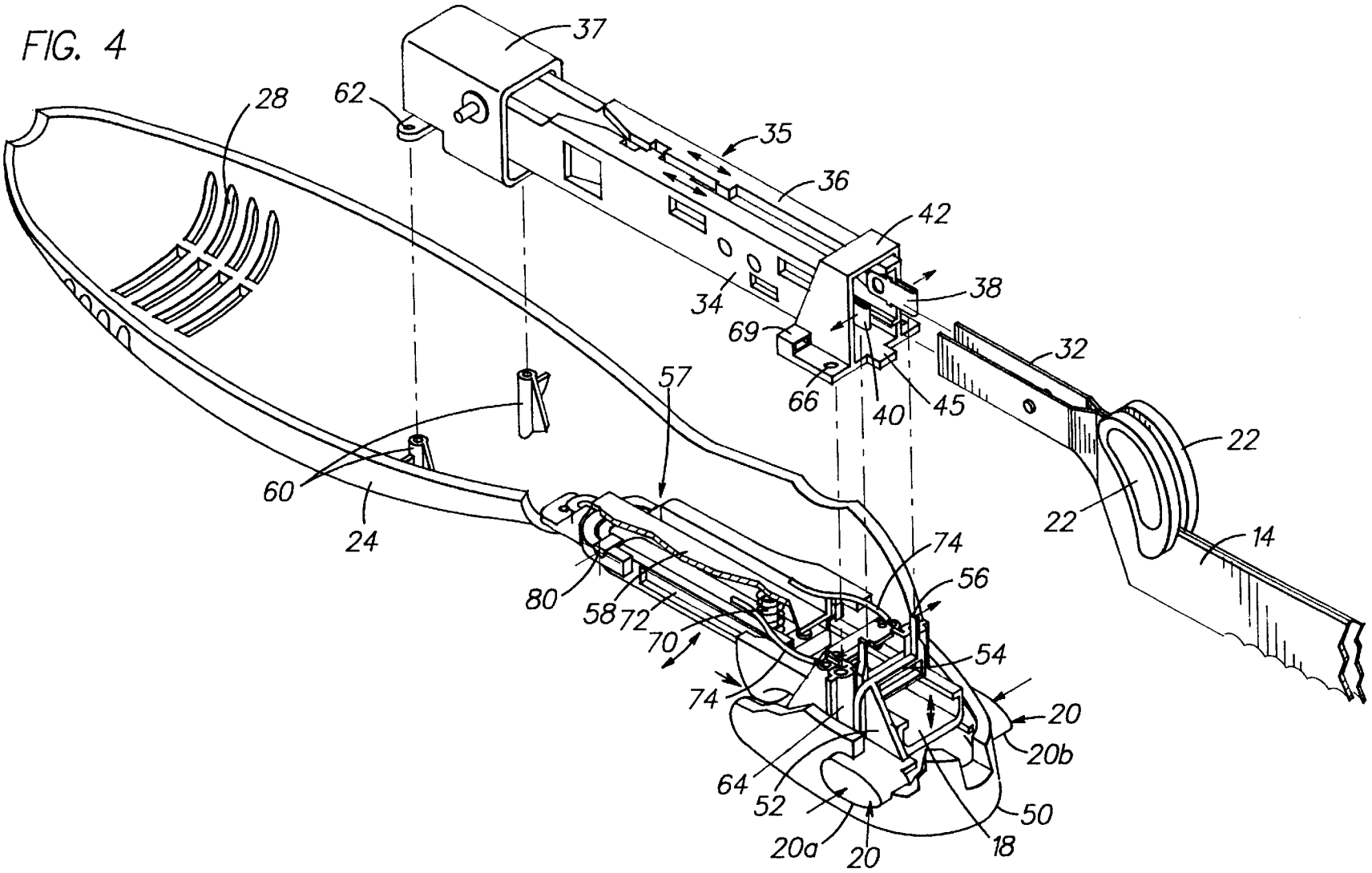
FIG. 4 is an exploded perspective view of an electric slicing knife designed in accordance with the present invention with parts omitted for purposes of clarity.
Figure 5:
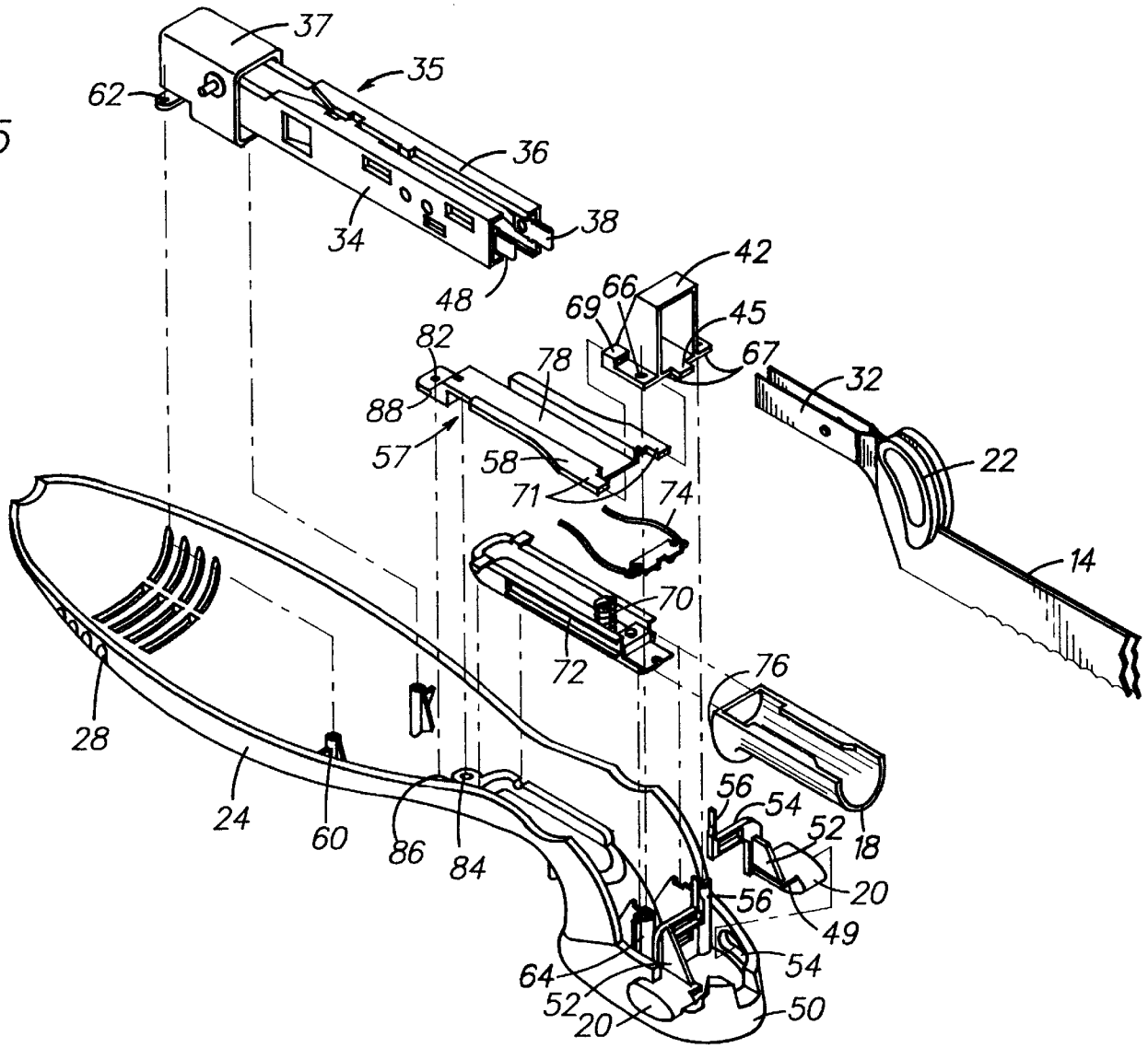
FIG. 5 is a further exploded perspective view with parts omitted for purposes of clarity providing additional details of the slicing knife of the present invention.

Referring now in particular to FIGS. 3, 4, and 5, further details of electric slicing knife 10 shall be described. Knife 10 includes a blade holder assembly 35 comprising a pair of blade holder members 34, 36 which are connected to gear 46 (shown in FIG. 8) for opposite reciprocating motion with respect to each other. Gear 46 converts rotary motion produced by motor 44 to reciprocating motion for effective use by blade holder members 34, 36. Each blade 14 includes a tang portion 32. Each tang portion 32 is held by a respective one of the blade holder members. In the preferred embodiment, the axial travel of each blade holder is approximately four millimeters. Blade holder assembly 35 further includes resilient means comprising first and second spring members 38, 40 for resiliently securing the tang of each blade member in its respective blade holder member 34, 36. Blade holder assembly 35 further includes rear and forward support frames 37, 42. Support frame 37 includes a pair of pads 62 which are aligned with bosses 60 when blade holder assembly 35 is mounted in lower housing portion 24. Blade holder assembly 35 is secured to housing portion 24 through joining bosses 60 with pads 62 through suitable means such as screws or the like.

Forward frame member 42 includes a pair of rearwardly extending legs 67. Each leg includes an opening 66. Each opening is aligned with a corresponding boss 64 for connecting forward frame member 42 to housing 24. Each leg 67 includes a member 69 forming an axially extending opening. The function of each opening shall be explained more fully hereinafter.

Switch 16 of knife 10 further includes a guide member 57 having a U-shaped portion formed by plate 78 and axially extending legs 58. Guide member 57 retains spring 70 of switch 16, prevents electrical power wires 74 from interfering with movement of blade holder assembly 35, returns switch 16 in its assembled position and guides the reciprocating motion of blade holder assembly 35. End 71 of each leg 58 extends within the opening formed in members 69 for aligning guide member 57 relative to forward frame member 42. Guide member 57 forms the top surface of switch 16. Screw openings 82, 88 in plate 78 are in alignment respectively with bosses 86, 84 for connecting guide member 57 to housing 24.

Each button assembly 20 includes a generally vertically extending triangular support member 52. A split beam-like member 54 extends radially inwardly from the upper end of each triangular member 52. Beam-like member 54 includes two-spaced horizontally extending arms 55, 57 which form an opening 49 therebetween. Finger 45 of frame number 42 extends axially within each opening 49. Inward radial movement of button assembly 20 is limited through engagement of one of the vertical faces forming opening 49 with one of the side edges of finger 45. Each button assembly 20 includes a vertically extending pin 56.

Figure 7:
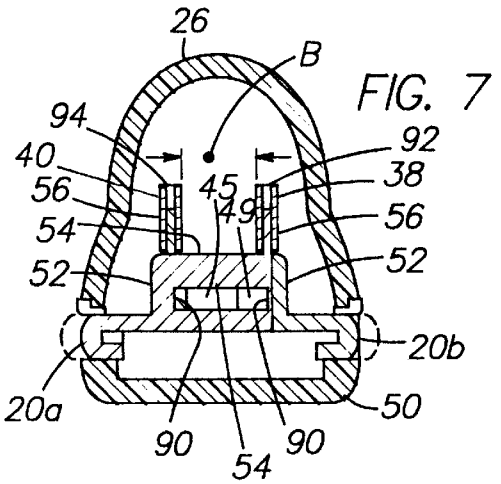
FIG. 7 is a view similar to that shown in FIG. 6 with the knife in a different operating state than that shown in FIG. 6.
Figure 6:
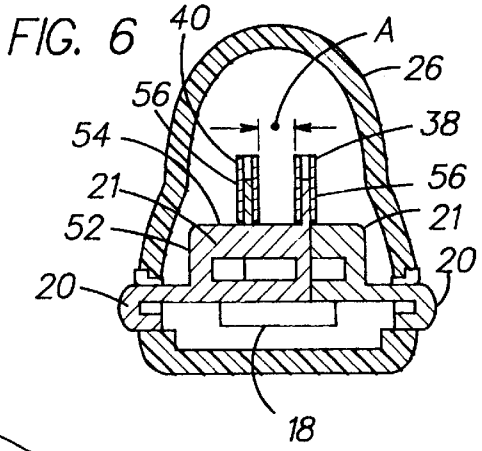
FIG. 6 is a sectional, somewhat diagramatic view of the slicing knife providing further details of the invention.

Referring specifically to FIGS. 6 and 7, it will be observed that each spring member 38, 40 of blade holder assembly 35 terminates in a generally U-shaped portion which forms vertically extending openings 92, 94 respectively in spring members 38, 40. FIG. 6 illustrates guard 18 in its forward position wherein guard 18 abuts opposed inner faces 90 of triangular support members 52. The position of guard 18 in FIG. 6 corresponds to the solid line position for guard 18 shown in FIG. 8. In FIG. 7, guard 18 is moved rearwardly so that it is no longer abutting the inside faces 90 of triangular support members 52, but rather is overlying switch 16. The position of guard 18 in FIG. 7 corresponds to the position shown for guard 18 in dotted or phantom lines in FIG. 8.

With reference to FIGS. 6 and 7, it will be observed that user actuated button 20A controls movement of the pin 56 within opening 92 of spring member 38. Thus, inward movement of button 20A moves spring member radially outwardly relative to the center of housing 12. Similarly, user actuated button 20B controls movement of finger 56 in opening 94 of spring member 40. When guard 18 is in the position shown in FIG. 6 in abutting relationship with faces 90, buttons 20A and 20B are in their outermost position with their respective fingers being moved inward relative to the center of housing 12. The abutting relationship between the surface of guard 18 and faces 90 prevents user actuated buttons 20A and 20B from being moved inward in a direction normal to the longitudinal axis of knife 10.

Similarly, when guard 18 is moved rearwardly so that it is no longer in abuttance relationship with vertical faces 90, user actuated buttons 20A and 20B can be moved inwardly so that their respective fingers move outwardly which in turn moves spring members 38 and 40 likewise outwardly. As shall be explained more fully hereinafter, when guard 18 is in the position shown in FIG. 6 (in solid line in FIG. 8) switch 16 may be actuated by the user to actuate slicing knife 10. When guard 18 is the position shown in FIG. 7 (and in dotted line in FIG. 8), the guard overlies switch 18 to prevent actuation of the switch.

Operation of the electric slicing knife as described above shall now be more fully explained. Assume that blades 14 are within blade holder 35 as shown in FIGS. 1, 2, and 3. Further assume that the user desired to operate the slicing knife to cut food. When it is desired to operate knife 10, guard 18 is moved forwardly to enable the user to actuate switch 16. The position of guard 18 in its forward position is shown, for example, in FIGS. 1, 2, 3, and 6. As particularly shown in FIG. 6, when guard 18 is moved forwardly, the surface thereof moves into abutting engagement with faces 90 of assemblies 20. Pins 56 of assemblies 20 are moved inwardly to likewise move spring members 38, 40 inwardly relative to blades 14. With spring members 38, 40 in their innermost radial position relative to the longitudinal axis of the blades, the blades are locked in their cutting position.

When the user is finished cutting food with knife 10 and desires to clean blades 14, the user will slide guard 18 rearwardly to override switch 16. When guard 18 overrides switch 16, the user cannot inadvertently actuate the switch. With guard 18 in its rearward position, the user can move buttons 20A and 20B radially inwardly (as shown in FIG. 7) which in turn moves fingers 56 of assemblies 20 outwardly to likewise move spring members 38, 40 outwardly. The outward movement of spring members 38, 40 releases blades 14 from their locked position relative to housing 12. The user then may readily remove the blades from the housing by grasping ears 22 of each blade 14.

It should be understood that while guard 18 has been specifically shown in the preferred embodiment as overlying switch 16, it is within the scope of the invention for guard 18 to be located in a different position relative to switch 16. For example, guard 18 may be positioned within switch 16 for movement relative to the switch. Likewise, guard 18 may be positioned behind the switch.

While a preferred embodiment of the present invention has been described and illustrated, the invention should not be limited thereto but may be otherwise embodied within the scope of the following claims.

What is claimed is:

1. An electrically operated slicing knife comprising:

a housing;

an electric motor mounted in said housing;

gear means for converting rotary motion of said motor to reciprocating motion;

a pair of blade holders connected to said gear means for opposite reciprocating motion with respect to each other;

a pair of blade members having adjacent faces in sliding engagement with each other, each of said blade members comprising a cutting portion and a tang portion, the tang portion of a first blade member being received by a first blade holder, and the tang portion of the second blade member being received by the second blade holder;

a resilient member for releaseably securing the blade members in the blade holders;

a user operated switch for selectively connecting the motor to a source of electrical power;

a switch guard overlying said switch and movable between a first position whereat the switch is uncovered to permit activation by said user and a second position whereat the switch is covered to prevent activation by said user; and movable locking means in operative relationship with said resilient member and said switch guard, said switch guard moving and retaining said locking means in a locking position relative to said resilient member when in said first position, said switch guard when in said second position enabling said user to move said locking means into an unlocking position relative to said resilient member.

2. An electrically operated slicing knife in accordance with claim 1 wherein one of said switch and said switch guard includes a track enabling said switch guard to move axially relative to said switch.

3. An electrically operated slicing knife in accordance with claim 2 wherein said locking means comprises a pair of lock members movable in a transverse direction relative to said blade members.

4. An electrically operated slicing knife in accordance with claim 3 wherein each of said lock members includes a user actuated button.

5. An electrically operated slicing knife in accordance with claim 4 wherein each of said lock members further includes a locking pin engaging a portion of said resilient member.

6. An electrically operated slicing knife in accordance with claim 1 wherein said locking means comprises a pair of lock members movable in a transverse direction relative to said blade members.

7. An electrically operated slicing knife in accordance with claim 6 wherein each of said lock members includes a user actuated button.

8. An electrically operated slicing knife in accordance with claim 7 wherein each of said lock members further includes a locking pin engaging a portion of said resilient member.

9. An electrically operated slicing knife in accordance with claim 3 wherein each of said lock members further includes a locking pin engaging a portion of said resilient member.

10. A method of operating an electrically powered knife comprising the steps of:

inserting a knife blade into a knife handle for cutting purposes;

placing an actuating switch in an on position to operate the blades in a cutting motion while simultaneously preventing the user from removing the blades from the handle;

placing the switch in an off position to deactivate the blades; and axially moving a guard to substantially block the switch to prevent user actuation thereof while simultaneously enabling the user to remove the blades from the handle.

11. An electrically operated slicing knife comprising:

a housing including a handle portion having upper and lower surfaces;

an electric motor mounted within the housing;

gear means mounted in the housing for converting rotary motion of said motor to reciprocating motion;

a switch mounted in the lower surface of said housing for selectively connecting the motor to a source of electrical power;

a switch guard overlying said switch and axially movable relative thereto between a first position whereat the switch is uncovered and a second position whereat the switch is covered to prevent a user from actuating the switch;

a pair of blade holders connected to said gear means for opposite reciprocating motion with respect to each other;

a pair of blade members having adjacent faces in sliding engagement with each other, each of said blade members comprising a cutting portion and a tang portion, the tang portion of a first blade member being received by a first blade holder, and the tang portion of the second blade member being received by the second blade holder;

a resilient member for releaseably securing the blade members in the blade holders; and locking means responsive to the position of said switch guard for selectively locking the resilient member for preventing removal of the blade members from the blade holders in response to the switch guard being placed in said first position.

12. An electrically operated slicing knife in accordance with claim 11 further including:

a pair of buttons each having a first portion extending through the housing for actuation by a user and a finger extending into engagement with a section of said resilient means when each of said buttons is in a first position for locking the resilient member to prevent removal of a blade member from a blade holder, said switch guard when in said first switch guard position locking said buttons in said first button position, said switch guard when in said second position enabling a user to actuate said buttons to disengage said fingers from said resilient means.

13. An electrically operated slicing knife in accordance with claim 12 wherein one of said switch and said switch guard includes a track for enabling said switch guard to move axially relative to said switch.

14. An electrically operated slicing knife comprising:

a housing;

an electric motor mounted in said housing;

gear means for converting rotary motion of said motor to reciprocating motion;

a pair of blade holders connected to said gear means for opposite reciprocating motion with respect to each other;

a pair of blade members having adjacent faces in sliding engagement with each other, each of said blade member comprising a cutting portion and a tang portion, the tang portion of said first blade member being received by a first blade holder, and a tang portion of the second blade member being received by the second blade holder;

a resilient member for releaseably securing the blade members in the blade holders;

a user operated switch for selectively connecting the motor to a source of electrical power;

a guard selectively movable by a user between active and inactive positions to prevent actuation of the switch by the user; and a pair of buttons, each having a first portion extending through the housing for actuation by a user and a finger extending into engagement with a section of said resilient means when each of said buttons is in a first position for locking the resilient member to prevent removal of a blade member from a blade holder, said buttons being in said first position in response to the guard being in an active position.

15. An electrically operated slicing knife in accordance with claim 14 wherein said switch includes a track for enabling said switch guard to move axially relative to said switch.

* * * * *